United States Patent [19]

Shimizu et al.

[11] 4,114,998

[45] Sep. 19, 1978

[54] COPYING MACHINE WITH REMOVABLE PHOTOSENSITIVE DRUM

[75] Inventors: Wataru Shimizu, Chigasaki; Eiji Sawaoka, Zama, both of Japan

[73] Assignee: Tokyo Shibaura Electric Co., Ltd., Kasawaki, Japan

[21] Appl. No.: 759,554

[22] Filed: Jan. 14, 1977

[51] Int. Cl.[2] ..... G03G 15/00

[52] U.S. Cl. ..... 355/3 DR; 29/123; 355/133

[58] Field of Search ..... 355/3 R, 3 DR, 11, 133; 29/123

[56] References Cited

U.S. PATENT DOCUMENTS

| | | | |
|---|---|---|---|
| 3,604,797 | 9/1971 | Szczesniak | 355/16 |
| 3,736,053 | 5/1973 | Shreeve et al. | 355/3 DR |
| 3,966,316 | 6/1976 | Pfeifer et al. | 355/3 DR |

*Primary Examiner*—Richard L. Moses

*Attorney, Agent, or Firm*—Cushman, Darby & Cushman

[57] ABSTRACT

An electrophotographic copying machine includes a photosensitive drum rotatably mounted in a housing. The drum may be taken out from the housing through an opening formed in the top wall thereof by a supporting mechanism when a covering for closing the opening is pivoted to open the opening.

5 Claims, 5 Drawing Figures

COPYING MACHINE WITH REMOVABLE PHOTOSENSITIVE DRUM

BACKGROUND OF THE INVENTION

The present invention relates to an electrophotographic copying machine and, more particularly to the one with a photosensitive drum mounted in a machine frame.

In paper jamming, maintenance or inspection of an electrophotographic copying machine (hereinafter referred to as photocopying machine for brevity), a photosensitive drum must be taken out of a machine frame. Nevertheless, in the conventional photocopying machine as disclosed in, for example U.S. Pat. No. 3,883,240, the rotary drum is fixed in the machine frame by means of screws, taking account of its fragility and the heavy weight of the drum per se. For this, the taking-out operation of the rotary drum can be accompanied only by an awkward operation. For example, the fixing screws are unscrewed and the rotary drum is manually taken out by carefully moving it in the limited space within the photocopying machine. Thus, removing the rotary drum is a nuisance and there is a high possibility that it will be damaged when it is taken out should it hit against the surrounding parts of the photocopying machine.

SUMMARY OF THE INVENTION

Accordingly, an object of the present invention is to provide an electrophotographic copying machine permitting a photosensitive rotary drum easily to be taken out from a machine frame without any manual and awkward operation.

BRIEF DRSCRIPTION OF THE DRAWING

FIGS. 1 to 5 show an electrophotographic copying machine according to an embodiment of the present invention wherein FIG. 1 is a schematic perspective view, FIG. 2 a cross sectional view along line 2—2 in FIG. 1, FIG. 3 a schematic perspective view showing a photosensitive rotary drum and a taking-out mechanism for the drum, FIG. 4 a perspective view similar to FIG. 3 except that the drum is taken out from a machine frame and FIG. 5 a cross sectional view of the rotary drum and a driving force transmitting mechanism thereof.

DESCRIPTION OF THE PREFERRED EMBODIMENT

An embodiment of an electrophotographic copying machine according to the present invention will now be described by way of example and with reference to the accompanying drawings.

Figure 1:
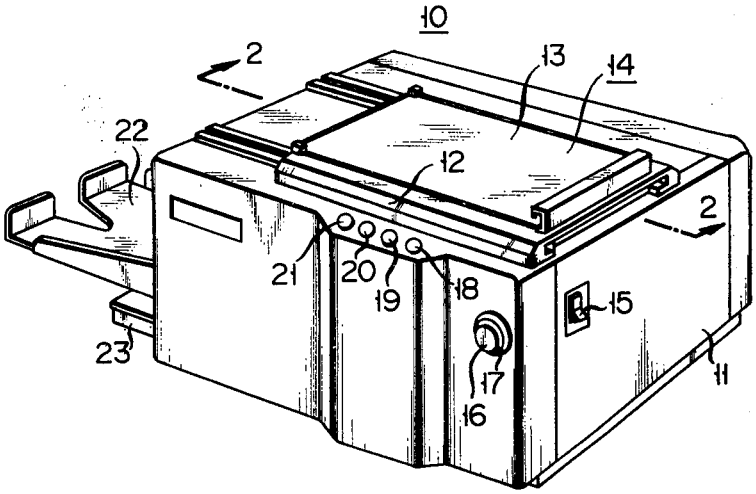
Figure 2:
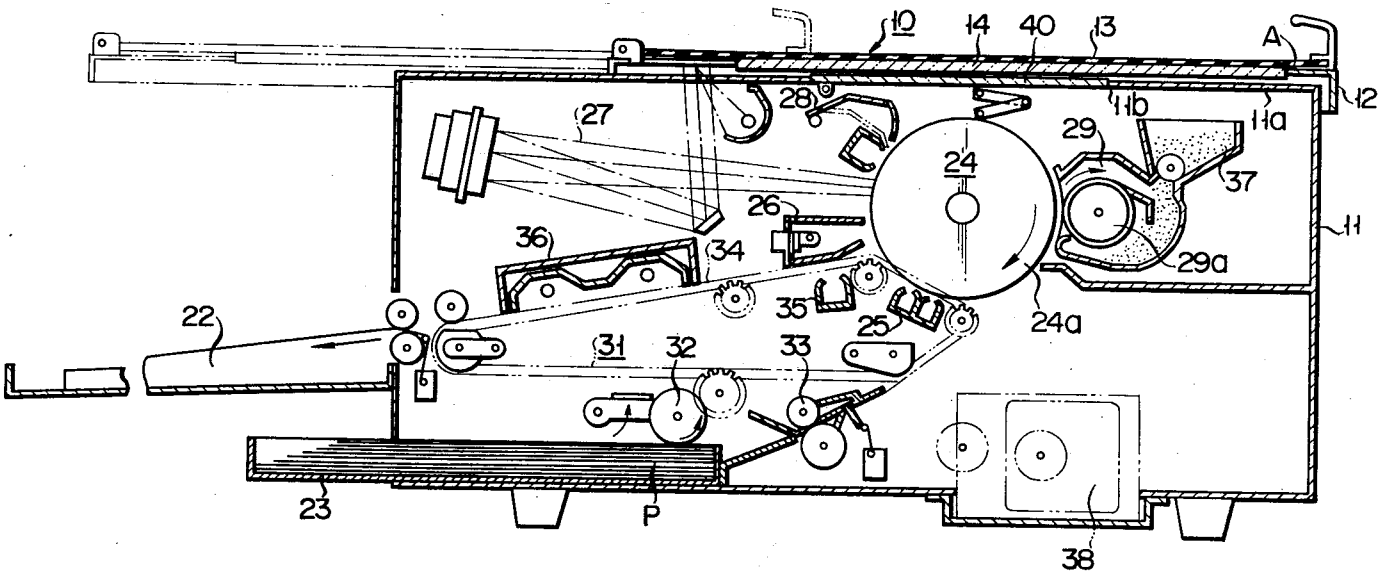

In FIGS. 1 and 2, a housing or machine frame 11 of an electrophotocopying machine 10 is provided with a top wall 11*a*. On the top wall 11*a*, an original supporting table or holder 14 is provided to be laterally slidable along conventional guide member (for example British Pat. No. 1,259,745). The supporting table 14 includes an original supporter 12 on which an original A is supported or placed and an original cover 13 and its slidable movement during the copying operation is effected through an action of a suitable drive mechanism.

As shown in FIG. 1, a power switch 15 is provided on the front portion of the right side wall of the housing

11, a print button 16 and a multi-copy selector dial 17 are provided on the right side of the front wall of the housing 11, and power lamp 18, ready lamp 19, check lamp 20 and empty lamp 21 are provided on the top wall. A receptacle 22 for receiving the sheets of copied paper is removably attached onto the left side wall of the housing 11. A paper feeding cassette 23 with some extension from the left side wall is put into a cassette holder portion formed on the left side bottom of the photocopying machine. Within the housing 11, a photosensitive rotary drum 24 with a photosensitive surface 24*a* thereon is rotatably provided which rotates clockwise with the same circumferential speed as the speed of the reciprocating movement of the supporting table 14. A copying mechanism is arranged around the photosensitive rotary drum 24, and one cycle of copying operation is completed for each two rotations of the drum 24. The copying mechanism includes a corona charging-transfer device 25 located under the rotary drum 24, and a residual image eraser 26, and exposure device 27 and a corona charge remover 28 arranged in clockwise order around the rotary drum 24. Downstream from the charge remover 28 is disposed a development-cleaning device 29. The development-cleaning device 29 may be fixedly mounted on the frame of the housing 11 as in the conventional photocopying machine. In this embodiment, the development-cleaning device 29 is mounted movably in a direction apart from the rotary drum 24, i.e. in the lateral direction of the photocopying machine through a suitable guide rail, not shown.

On the left lower side of the rotary drum 24 in the housing 11 is provided a transporting mechanism 31 for feeding the sheets of copy paper (transferring paper) P one by one from the paper feeding cassette 23 to the photosensitive rotary drum 24 and for feeding out to the receptacle 22 the copy paper P electrophotographically processed around the rotary drum 24. The transporting mechanism 31 includes a paper feeding roller 32 above the paper feeding cassette 23, a pair of pinch rollers 33 for moving forward the copy paper P taken out by the paper feeding roller 32 from the paper feeding cassette 23, and an endless belt 34 for transporting the copy paper P after passing the pinch rollers 33 between the photosensitive drum 24 and the charging-transferring means 25 and then feeding out to the receptacle 22 the copy paper photocopied through the rotary drum 24. A copy paper corona charge remover 35 and a fixing means 36 are disposed downstream along the copy paper transporting path of the endless belt 34. The developement-cleaning means 29 with a magnetic brush 29*a* is further coupled with a toner supply means 37. A drive motor 38 is used to drive various components of the photocopying machine.

Figure 3:
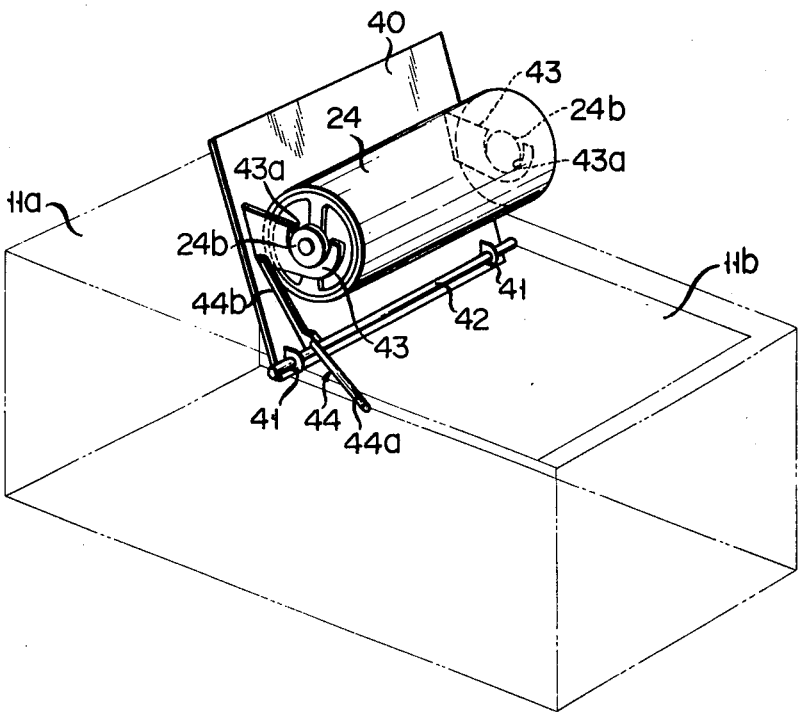
Figure 4:
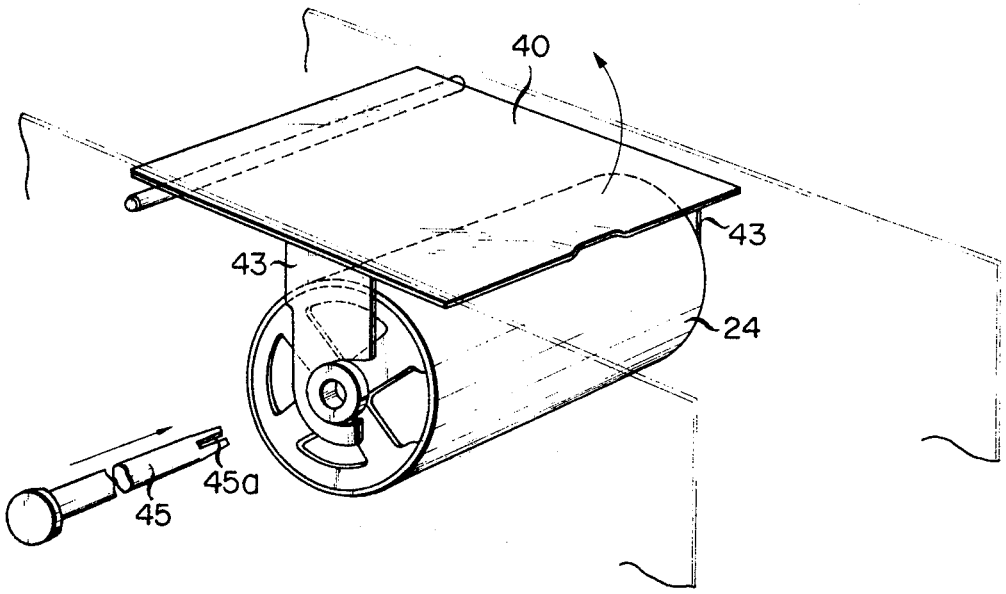
Figure 5:
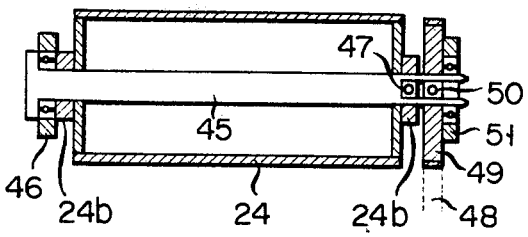

A rectangular opening 11*b* is formed in the top wall 11*a* above the rotary drum 24 and is normally closed by a rectangular cover 40 and is opened when the rotary drum 24 is taken out for inspection, changing or maintenance of the drum, as shown in FIG. 3. A pair of projections 41 with holes spaced apart are formed on the inner surface of the cover 40. A bar 42 is passed through the holes of the projections 41 and is fixed to the opposite walls of the housing 11 at both ends. Therefore, the cover 40 may be swung around the bar 42. A pair of supporting arms 43 are further provided on the inner surface of the cover 40. The supporting arms 43 are properly spaced apart to each other for supporting the rotary drum 24. The supporting arms are provided each with a substantially half circular cut-away portion 43*a* in one side. A pair of ring-shaped members 24*b* are coaxially attached to both sides of the rotary drum 24, respectively, and are supported by the cut-away portions 43*a* of the supporting arms 43 when the rotatable drum 24 is taken out of the photocopying machine. After the rotary drum 24 is set at the outside of the photocopying machine by swinging the cover 40, the ring-shaped members 24*a* remain in the cut-away portions as shown in FIG. 3, thereby preventing the rotary drum 24 from running off from the supporting arm 43. Under this condition, the cover 40 is supported by latching mechanism 44 coupled between the cover 40 and the frame of the housing 11. Each fixing mechanism 44 is comprised of a lower arm 44*a* and an upper arm 44*b*. One end of the lower arm 44*a* is pivoted on the frame while the other end thereof is rotatably coupled with one end of the upper arm 44*b*. The other end of the upper arm 44*b* is rotatably coupled with the supporting arm 43. The cover 40 may be supported by the mechanism 44 when the angle between both the arms 44*a* and 44*b* slightly exceeds 180°. The drum 24 may be put back into the inside of the photocopying machine, when the cover 40 is closed. That is, through the closing operation of the cover 40, the rotary drum 40 also moves into the inside of the machine to be positioned as shown in FIG. 4. The drive ready condition of the rotary drum 24 is prepared in the following setting steps. A rotatable shaft 45 with a notch 45*a* at the tip is inserted into the center hollow of the rotary drum 24 through a bearing 46. At this time, the insertion must be made by slightly rotating the shaft 45 so as to position, in the notch 45*a*, a pin 47 planted on the ring-shaped member 24*a* and another pin 50 planted on the center hole of the gear 49 driven by the motor 38 through a chain 48. Finally, the notched tip is put in a bearing 51. With such a construction, the motor 38 drives gear 49 thus the shaft 45 to rotate the rotary drum 24.

When the rotary drum 24 is taken out of the machine for inspection or maintenance, the developing-cleaning device 29 is moved, the shaft 45 is pulled out from the rotary drum 24, and then the cover 40 is swung to open the rectangular opening 11*b* of the top wall 11*a*.

In the embodiment described above, the cover is rotatably mounted to the housing. It will be understood, however, that it may be mounted so as just to be moved upward. Further, it may be moved not only by hand but also by using an oil pressure drive mechanism of oil piston or an electrical drive mechanism of motor.

Moreover, the rotary drum may be supported by supporting means provided with bearings in which it is journalled. In this case, if gears are directly mounted to the drum, but may be disengaged from the drive mechanism, the rotary shaft is not needed and the rotary drum may be easily taken out and put back.

The electrophotographic copying machine according to the present invention may be applied to a manually paper feeding type without a cassette as well as the cassette loading type. Further, the paper feeding mechanism and the copy paper receptacle may be provided at the separate portions of the photocopying machine, unlike the above-mentioned embodiment.

The copying machine of the invention is not limited to a type of one copying cycle by two drum-rotations described above, and may be applied to the other types, for example one copying cycle by one drum-rotation.

What we claim is:

1. An electrophotographic copying machine comprising:

a housing with a top wall having an opening;

a photosensitive rotary drum accommodated in said housing;

copying means for effecting copying operation in cooperation with said drum;

covering means mounted to said top wall to close the opening therein and movable to open said housing means for attaching the covering means to said top wall of the housing so as to be pivotable around one side of the covering means; and supporting means mounted on said covering means and supporting said drum to shift the drum outside of said housing through the opening by moving said covering means to open said housing, including a pair of supporting members projected from both sides of said drum, and a pair of supporting arms each having one end fixed on said covering means and the other end supporting said supporting member, said supporting members each including a circular body and said supporting arms each including a cut-away portion at one side having a curved surface so as to support a circular body in said housing and while outside said housing.

2. An electrophotographic copying machine according to claim 1, further comprising an original supporting table for supporting an original thereon which is movable on said top wall of said housing to expose the covering means whereby the covering means can be pivoted about an axis to open said housing.

3. An electrophotographic copying machine according to claim 1, further comprising means for latching said covering means with said housing open when said drum is outside said housing.

4. An electrophotographic copying machine according to claim 3, in which said latching means includes first and second arms, said first arm having one end rotatably coupled with said housing and the other end rotatably coupled with one end of said second arm and said second arm having the other end rotatably coupled with said covering means.

5. An electrophotographic copying machine according to claim 1, further comprising a drive means for driving said drum and coupling means operably coupling said drive means with said drum.

* * * * *